US006038513A

United States Patent [19]

Varsamis et al.

[11] Patent Number: 6,038,513

[45] Date of Patent: Mar. 14, 2000

[54] METHOD AND APPARATUS FOR QUICK DETERMINATION OF THE ELLIPTICITY OF AN EARTH BOREHOLE

[75] Inventors: Georgios L. Varsamis; Laurence T. Wisniewski, both of Houston; Carey R. Murphey, Bellaire, all of Tex.

[73] Assignee: Dresser Industries, Inc., Dallas, Tex.

[21] Appl. No.: 09/159,056

[22] Filed: Sep. 23, 1998

Related U.S. Application Data

[60] Provisional application No. 60/090,831, Jun. 26, 1998.

[51] Int. Cl.[7] ..... G01V 1/40

[52] U.S. Cl. ..... 702/6; 702/16

[58] Field of Search ..... 73/151.01; 367/27, 367/25, 35, 173; 702/6, 16

[56] References Cited

U.S. PATENT DOCUMENTS

| | | | |
|---|---|---|---|
| 1,240,328 | 9/1917 | Fessenden | 367/25 |
| 3,309,656 | 3/1967 | Godbey | 367/25 |
| 4,665,511 | 5/1987 | Rodney et al. | 367/35 |
| 4,803,667 | 2/1989 | Siegfried, II | 367/69 |
| 5,317,111 | 5/1994 | Orban et al. | 181/105 |
| 5,354,956 | 10/1994 | Orban et al. | 181/105 |
| 5,444,324 | 8/1995 | Priest et al. | 310/334 |
| 5,469,736 | 11/1995 | Moake | 73/151 |
| 5,638,337 | 6/1997 | Priest | 367/27 |
| 5,678,643 | 10/1997 | Robbins et al. | 175/45 |
| 5,724,308 | 3/1998 | Sorrells et al. | 367/34 |
| 5,737,277 | 4/1998 | Priest | 367/27 |
| 5,763,773 | 6/1998 | Birchak et al. | 73/152.58 |
| 5,877,996 | 3/1999 | Krokstad | 367/31 |

OTHER PUBLICATIONS

Priest, Computing Borehole Geometry and Related Parameters from Acoustic Caliper Data, *SPWLA 38th Annual Logging Symposium*, Houston, TX, Jun. 15–18, 1997, p. 1–13.

Moake, et al., Standoff and Caliper Measurements While Drilling Using a New Formation–Evaluation Tool with Three Ultrasonic Transducers, *SPE Drilling & Completion*, Jun. 1995, p. 104–111.

Althoff, et al., MWD Ultrasonic Caliper Advanced Detection Techniques, *SPWLA 39th Annual Logging Symposium*, Keystone, CO, May 26–29, 1998, p. 1–14.

Birchak, et al., Standoff and Caliper Measurements While Drilling Using a New Formation–Evaluation Tool with Three Ultrasonic Transducers, SPE Paper No. 26494, *68th Annual Technical Conference and Exhibition*, Houston, TX, Oct. 3–6, 1993, p. 104–111.

*Primary Examiner*—Christine K. Oda
*Assistant Examiner*—Victor J. Taylor
*Attorney, Agent, or Firm*—Cox & Smith Incorporated

[57] ABSTRACT

A downhole apparatus is provided for quickly and accurately estimating the ellipticity of an earth borehole during any drilling operation using circle-based calculations involving statistical analysis of distance measurements made by acoustic sensors. A corresponding method of estimating such ellipticity is also disclosed.

17 Claims, 4 Drawing Sheets

METHOD AND APPARATUS FOR QUICK DETERMINATION OF THE ELLIPTICITY OF AN EARTH BOREHOLE

This application claims priority from U.S. provisional application Ser. No. 60/090,831 filed Jun. 26, 1998.

BACKGROUND OF THE INVENTION

1. Field of the Invention

This invention relates generally to a method and apparatus for quick determination of the ellipticity of an earth borehole using statistical analysis of distance measurements provided by acoustic sensors.

2. Description of the Related Art

The ellipticity of a borehole traversing an earth formation is useful in ascertaining other valuable information regarding various properties of the formation, such as stresses, porosity, and density. Additionally, borehole ellipticity is useful in evaluating well bore stability and hole cleaning operations. Several methods to obtain information about the ellipticity of a borehole are described in U.S. Pat. No. 5,469,736 to Moake, U.S. Pat. No. 5,638,337 to Priest, U.S. Pat. No. 5,737,277 to Priest, and references cited therein, each of which is incorporated herein by reference. Such methods generally employed acoustic or mechanical calipers to measure the distance from the tool to the borehole wall at a plurality of points around the perimeter of the tool. However, those methods have several drawbacks.

For example, various wireline tools having mechanical calipers have been used to mechanically measure the dimensions of a borehole. However, those techniques require the removal of the drillstring, which results in costly down time. Additionally, such techniques do not allow measurement while drilling (MWD). Moreover, the method described in the '736 patent to Moake appears to be based on the assumption that the borehole shape is circular, or at least that the shape may be approximated by an "equivalent" circle, i.e., a circle having an area equivalent to that of the actual borehole. A significant drawback to that method is that, in reality, the borehole shape is often not circular but is rather of an elliptical shape. Therefore, under many circumstances, that method does not accurately describe the true borehole shape. Furthermore, although the methods described in the '337 and '277 patents do account for the ellipticity of a borehole and tool rotation during measurement, those methods assume that the tool does not translate in the borehole during measurement. During drilling operations, however, the tool is rarely free from translational motion. Thus, those methods generally do not provide satisfactory results in an MWD mode of operation. Another drawback of those methods is that the calculations are too complex and slow for some drilling operations, particularly wiping, sliding, or tripping operations. Moreover, many of those methods require excessive downhole computing power. Thus, there is a need for increased speed and a reduction in the required downhole computing power in determining the ellipticity of the borehole so that the calculations may be made during any drilling operation.

It would, therefore, be a significant advance in the art of petroleum well drilling and logging technology to provide a method and apparatus for quickly and accurately determining the ellipticity of an earth borehole while drilling the borehole or while wiping, sliding, or tripping.

SUMMARY OF THE INVENTION

Accordingly, it is an object of this invention to provide an improved downhole method and apparatus for quickly and accurately estimating the ellipticity of an earth borehole during any drilling operation. The present invention greatly enhances the speed of determining ellipticity by employing fast, circle-based calculations involving statistical analysis of distance measurements provided by acoustic sensors. This invention also requires significantly less computing power than that of the prior art.

BRIEF DESCRIPTION OF THE DRAWINGS

This invention may best be understood by reference to the following drawings.

DETAILED DESCRIPTION OF A PREFERRED EMBODIMENT

Figure 1:
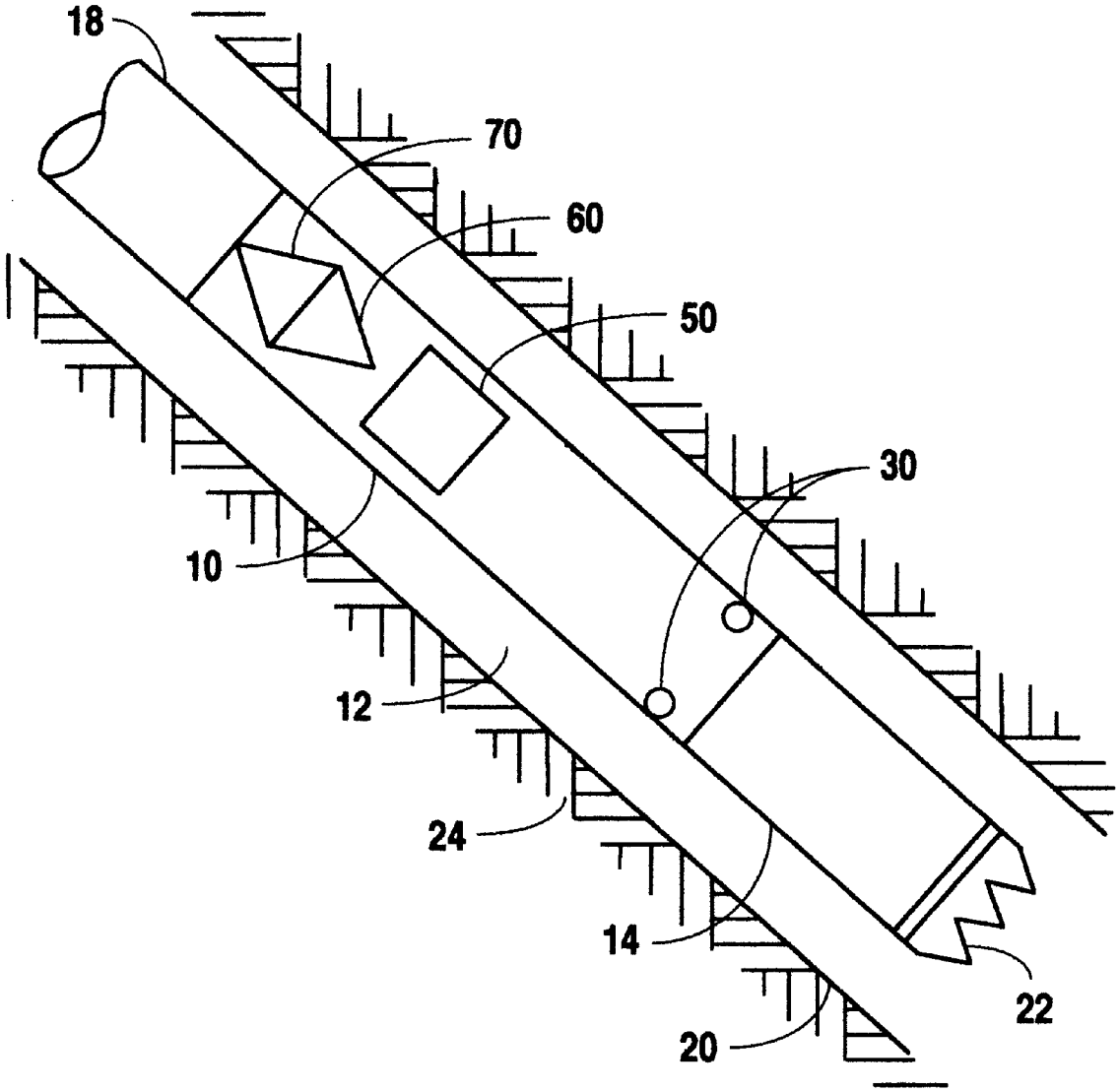
FIG. 1 is a schematic elevational view of a tool in accordance with the present invention disposed within an earth borehole.

Referring to FIG. 1, in a preferred embodiment of this invention, a tool 10, that is preferably an MWD tool, is mounted in a section of a rotating drill string 18 disposed within a borehole 12 traversing an earth formation 24. A drill bit 22 is mounted at the bottom of the drill string 18 to facilitate the drilling of the borehole 12. Drill bit 22 is connected to the drill string 18 with a drill collar 14. Tool 10 preferably includes three acoustic transceivers 30 (only two are shown in FIG. 1) to measure the distance from the tool 10 to the borehole wall 20. Additionally, tool 10 includes a signal processor 50 to process the signals from the acoustic transceivers 30 and to perform the ellipticity calculations. Tool 10 further includes at least one of the following data disposition devices, namely, a data storage device 60 to store ellipticity data and a data transmitter 70, such as a conventional mud pulse telemetry system, to transmit ellipticity data to the surface. Acoustic transceivers 30 are preferably those of the type disclosed in application Ser. No. 08/920,929 filed Aug. 29, 1997, by Arian et al., which is incorporated herein by reference. In a preferred embodiment, three acoustic transceivers 30 are equally spaced (120° apart) around the perimeter of the tool 10, as shown in FIG. 2.

Figure 2:
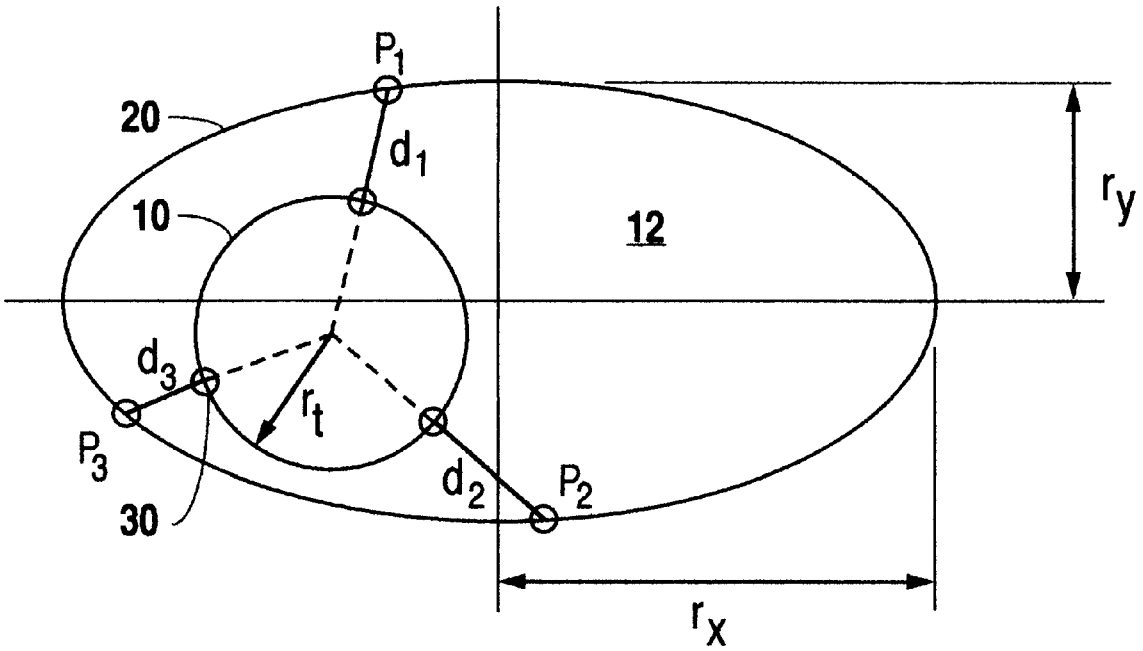
FIG. 2 is a schematic sectional view illustrating sample distance measurements made by a tool disposed within an elliptical borehole in accordance with the present invention.
Figure 3:
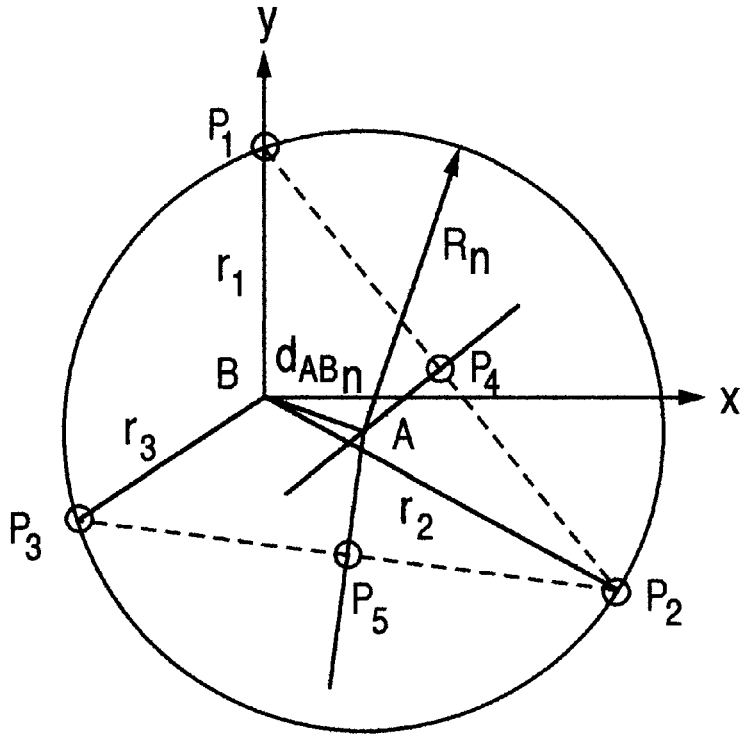
FIG. 3 is a graphical view illustrating an assumed circular borehole to be used in the ellipticity calculations in accordance with the present invention.

Referring to FIGS. 2 and 3, distances $d_i$ (i=1, 2, 3) from the tool 10 to the borehole wall 20 are measured at three locations around the periphery of the tool 10 at a plurality of times (firings) corresponding to different positions of the tool 10 as it rotates within the borehole 12. For each firing, the acoustic transceivers 30 measure the standoff distances $d_i$ according to the equation $$d_i = \frac{v_m t}{2} \qquad \text{Eq. [1]}$$

where $v_m$ is the acoustic velocity through the mud between the tool 10 and the borehole wall 20 and t is the round trip transit time of the acoustic signal between the tool 10 and the borehole wall 20. The three distances $r_i$ from the center B of the tool 10 to the three measured points $P_i$ on the borehole wall 20 are calculated according to the equation $$r_i = r_t + d_i \quad \text{Eq. [2]}$$

where $r_t$ is the radius of the tool 10. For each firing n (n=1, 2, 3, . . . N), the three distances $r_i$ are used to calculate the radius $R_n$ of an assumed circle defined by the three measured points $P_i$ on the borehole wall 20. The center A of the circle is defined by the intersection of lines drawn perpendicular to and bisecting the chords that connect points $P_i$. Also for each firing n, the eccentric distance $d_{AB_n}$ from the center B of the tool 10 to the center A of the assumed circle is calculated. Then, various statistics of $R_n$ and $d_{AB_n}$ are used to estimate the ellipticity of the borehole 12. The radius $R_n$ and eccentric distance $d_{AB_n}$ are calculated according to the method disclosed by Althoff, et al. in "MWD Ultrasonic Caliper Advanced Detection Techniques," 39th Annual Logging Symposium Transactions, Society of Professional Well Log Analysts, Keystone, Colo., May 26–29, 1998.

Figure 4:
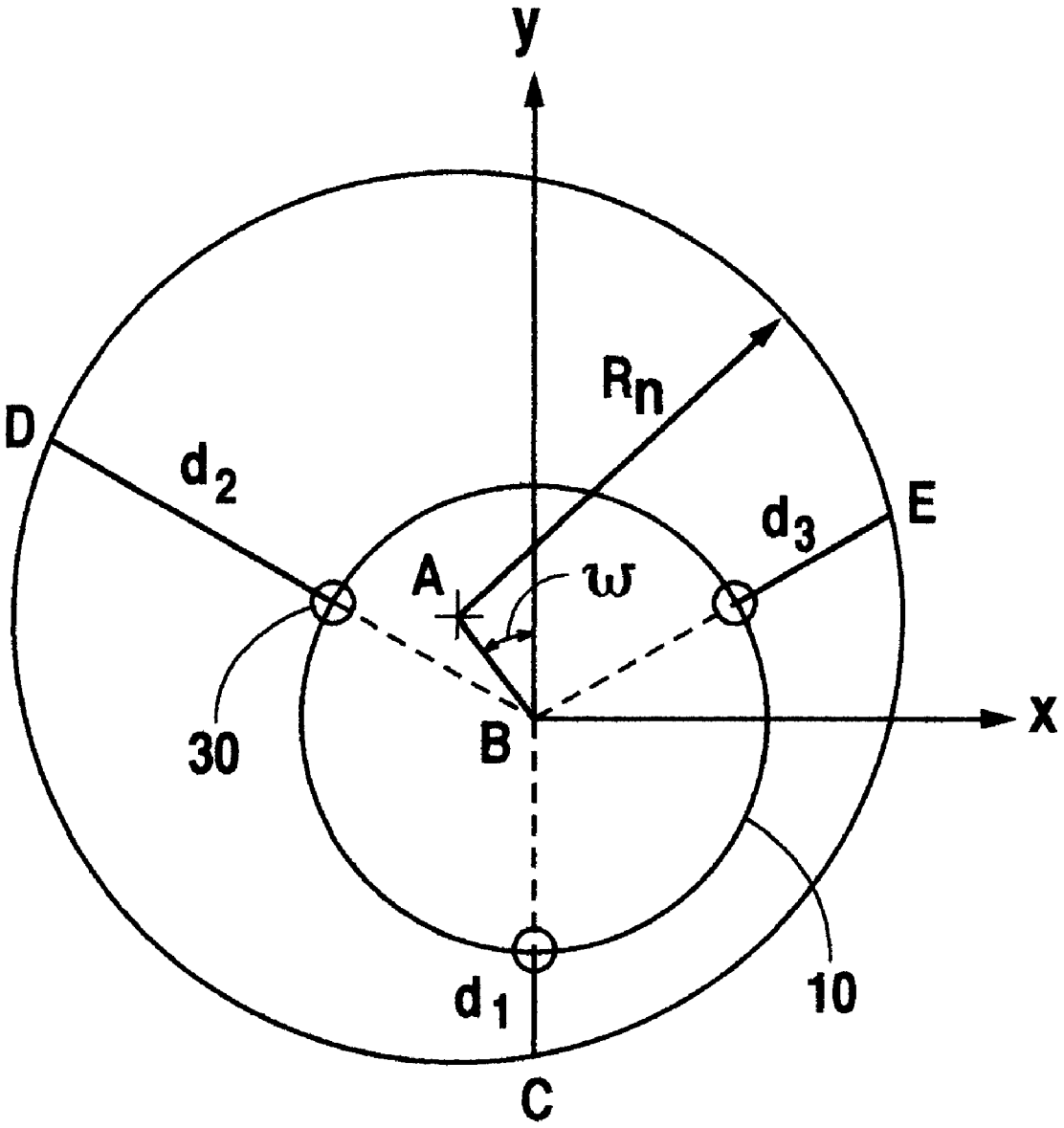
FIG. 4 is an additional graphical view illustrating an assumed circular borehole to be used in the ellipticity calculations in accordance with the present invention.

As taught by Althoff et al., and referring to FIG. 4, the generalized equation of a circle with center A(X, Y) in coordinates x and y is given by:

$$(x-X)^2+(y-Y)^2=R_n^2 \quad \text{Eq. [3]}$$

The equations for points C, D, and E will then be (taking into account the fact that the transducers 30 are spaced 120 degrees apart):

$$(0-X)^2+(r_1-Y)^2=R_n^2 \quad \text{Eq. [4]}$$

$$\left(-\frac{\sqrt{3}}{2}r_2-X\right)^2+\left(\frac{1}{2}r_2-Y\right)^2=R_n^2$$

$$\left(\frac{\sqrt{3}}{2}r_3-X\right)^2+\left(\frac{1}{2}r_3-Y\right)^2=R_n^2$$

The set of Equations [4] can be solved for the values of X, Y, and $R_n$. The result is given by the equations:

$$X=-\frac{\sqrt{3}}{6}\frac{(r_2r_3+2r_2r_1+r_1^2+2r_1r_3)(r_2-r_3)}{(r_2r_3+r_2r_1+r_1r_3)} \quad \text{Eq. [5]}$$

$$Y=-\frac{1}{2}\frac{(r_2+r_3)(-r_2r_3+r_1^2)}{(r_2r_3+r_2r_1+r_1r_3)}$$

$$R^2=\frac{1}{3}\frac{(r_2r_3+r_2^2+r_3^2)(r_1r_3+r_1^2+r_3^2)(r_2r_1+r_1^2+r_2^2)}{(r_2r_3+r_2r_1+r_1r_3)^2}$$

The distance between the two centers (distance AB in FIG. 4) is given by the equation:

$$d_{AB_n}=\sqrt{X^2+Y^2} \quad \text{Eq. [6]}$$

The angle between the line defined between the two centers (A and B) and the line defined between the center of the tool 10 and the transducer 30 that measures standoff distance $d_1$ (angle ω in FIG. 4) is given (with a 180 degree ambiguity) by the equation:

$$\tan\omega=\frac{X}{Y} \quad \text{Eq. [7]}$$

Referring to FIG. 2, the ellipticity E of a borehole 12 is defined by the ratio of the major radius $r_x$ to the minor radius $r_y$, $$E=\frac{r_x}{r_y} \quad \text{Eq. [8]}$$

However, $r_x$ and $r_y$ cannot be measured directly. Nevertheless, the ellipticity E may be quickly and accurately estimated using various statistics of $R_n$ and $d_{AB_n}$, such as the mean and standard deviation. For example, tests have shown that an equation of the following form yields good results for E while maintaining a very fast computation speed:

$$E=b_1+b_2\overline{R}+b_3\sigma_R+b_4\overline{R}^2+b_5\sigma_R^2+\ldots$$
$$+c_2\overline{d}_{AB}+c_3\sigma_{d_{AB}}+c_4\overline{d}_{AB}^2+c_5\sigma_{d_{AB}}^2+\ldots \quad \text{Eq. [9]}$$

where $\overline{R}$ is the mean of $R_n$, $\overline{d}_{AB}$ is the mean of $d_{AB_n}$, $\sigma_R$ is the standard deviation of $R_n$, $\sigma_{d_{AB}}$ is the standard deviation of $d_{AB_n}$, and $b_1$, $b_2$, $b_3$ . . . $b_k$ and $c_2$, $c_3$ . . . $c_k$ are constants. Alternatively, the following simplified equation may be used:

$$E=1+\frac{\overline{d_{AB}}}{2} \quad \text{Eq. [10]}$$

Although it is counterintuitive that an equation so simple as Eq. [10] could accurately model an elliptically shaped borehole, tests have shown that Eq. [10] yields quite satisfactory results.

Figure 5:
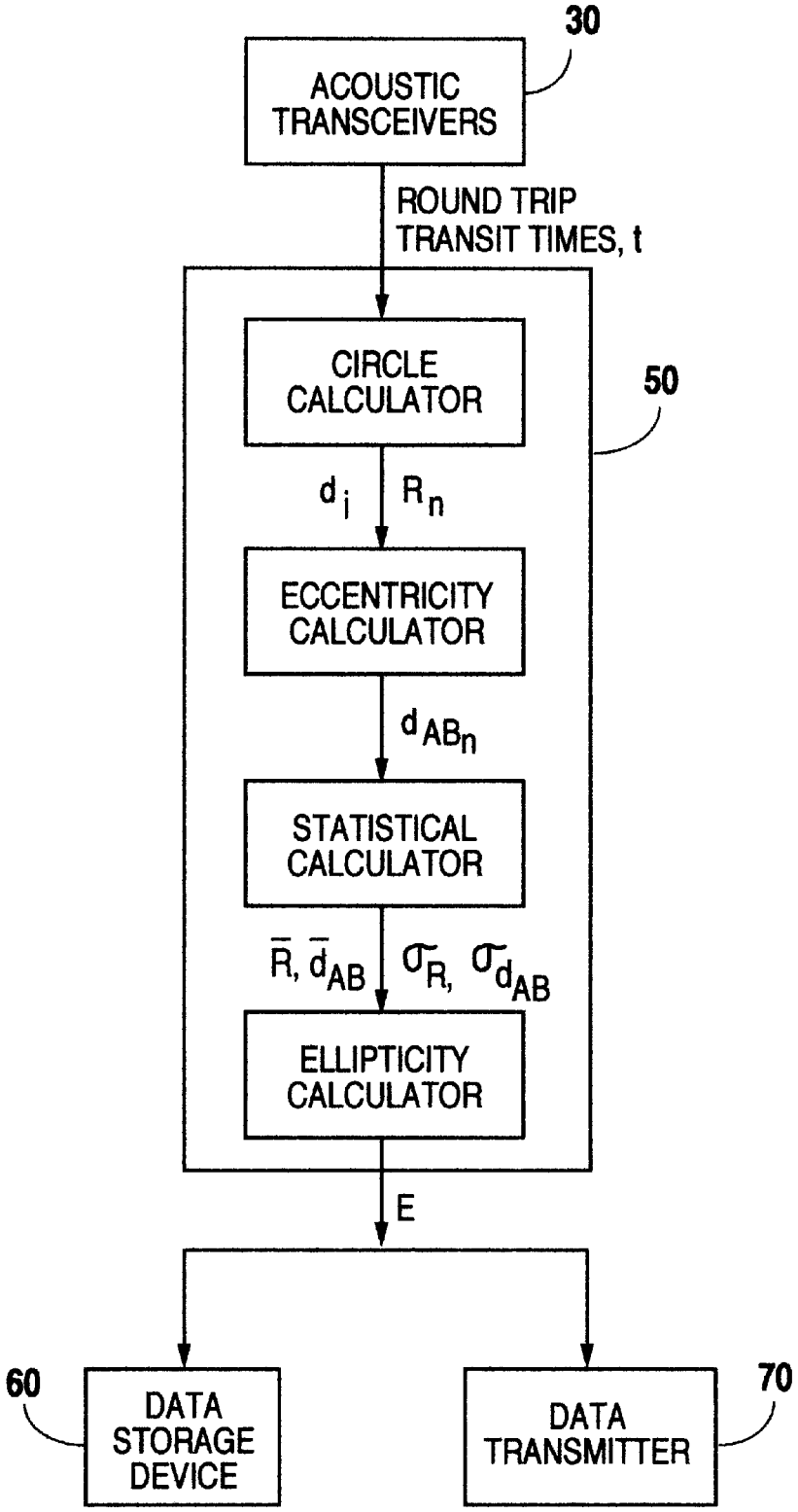
FIG. 5 is a schematic flow chart showing a preferred arrangement of components of a tool in accordance with the present invention.

Referring to FIG. 5, the required calculations are performed by a signal processor 50, which preferably comprises a properly programmed microprocessor, digital signal processor, or digital computer. Signal processor 50 is first used as a circle calculator to calculate the radii $R_n$ of assumed circles based on distances $r_i$ (FIG. 3). Signal processor 50 also functions as an eccentricity calculator to calculate the eccentric distances $d_{AB_n}$ from the center A of the tool 10 to the center B of each assumed circle (FIG. 3). Additionally, signal processor 50 functions as a statistical calculator to calculate various statistics of $R_n$ and $d_{AB_n}$, such as the mean and standard deviation. Further, signal processor 50 functions as an ellipticity calculator to calculate the ellipticity E of the borehole using the various statistics of $R_n$ and $d_{AB_n}$. The ellipticity E is then sent to data storage device 60 and/or data transmitter 70, as desired.

Although the foregoing specific details describe a preferred embodiment of this invention, persons reasonably skilled in the art of petroleum well drilling and logging will recognize that various changes may be made in the details of the method and apparatus of this invention without departing from the spirit and scope of the invention as defined in the appended claims. Therefore, it should be understood that this invention is not to be limited to the specific details shown and described herein.

We claim:

1. An apparatus for estimating the ellipticity of an earth borehole using a rotating tool, said tool comprising:

(a) acoustic sensors spaced peripherally around said tool at multiple sensor locations for generating standoff signals representative of at least three respective standoff distances from said sensor locations to at least three respective points on the wall of said borehole at a plurality of measurement times;

(b) a circle calculator in communication with said acoustic sensors for receiving said standoff signals and generating a radius signal representative of the radius of a circle defined by said at least three points on the wall of said borehole for each of said measurement times;

(c) a statistical calculator in communication with said circle calculator for receiving said radius signal for each of said measurement times and generating a statistical signal representative of at least one statistic of said radii;

(d) an ellipticity calculator in communication with said statistical calculator for receiving said statistical signal and generating an ellipticity signal representative of the ellipticity of said borehole based on said at least one statistic; and (e) at least one data disposition device in communication with said ellipticity calculator selected from the group consisting of (i) a data storage device for receiving said ellipticity signal and storing ellipticity data representative of the ellipticity of said borehole, and (ii) a data transmitter for receiving said ellipticity signal and transmitting said ellipticity signal to the surface.

2. The apparatus of claim 1 wherein said acoustic sensors comprise three acoustic transceivers equally spaced around said tool.

3. An apparatus for estimating the ellipticity of an earth borehole using a rotating tool, said tool comprising:

(a) acoustic sensors spaced peripherally around said tool at multiple sensor locations for generating standoff signals representative of at least three respective standoff distances from said sensor locations to at least three respective points on the wall of said borehole at a plurality of measurement times;

(b) an eccentricity calculator in communication with said acoustic sensors for receiving said standoff signals and generating an eccentricity signal representative of the eccentric distance from the center of a circle defined by said at least three points on the wall of said borehole to the center of said tool for each of said measurement times;

(c) a statistical calculator in communication with said eccentricity calculator for receiving said eccentricity signal for each of said measurement times and generating a statistical signal representative of at least one statistic of said eccentric distances;

(d) an ellipticity calculator in communication with said statistical calculator for receiving said statistical signal and generating an ellipticity signal representative of the ellipticity of said borehole based on said at least one statistic; and (e) at least one data disposition device in communication with said ellipticity calculator selected from the group consisting of (i) a data storage device for receiving said ellipticity signal and storing ellipticity data representative of the ellipticity of said borehole, and (ii) a data transmitter for receiving said ellipticity signal and transmitting said ellipticity signal to the surface.

4. The apparatus of claim 3 wherein said acoustic sensors comprise three acoustic transceivers equally spaced around said tool.

5. The apparatus of claim 3 wherein:

(a) said at least one statistic of said eccentric distances comprises the mean of said eccentric distances; and (b) said ellipticity calculator operates according to the equation $$E = 1 + \frac{\overline{d_{AB}}}{2}$$

wherein E is the ellipticity of said borehole and $\overline{d}_{AB}$ is the mean of said eccentric distances.

6. An apparatus for estimating the ellipticity of an earth borehole using a rotating tool, said tool comprising:

(a) acoustic sensors spaced peripherally around said tool at multiple sensor locations for generating standoff signals representative of at least three respective standoff distances from said sensor locations to at least three respective points on the wall of said borehole at a plurality of measurement times;

(b) a circle calculator in communication with said acoustic sensors for receiving said standoff signals and generating a radius signal representative of the radius of a circle defined by said at least three points on the wall of said borehole for each of said measurement times;

(c) an eccentricity calculator in communication with said acoustic sensors for receiving said standoff signals and generating an eccentricity signal representative of the eccentric distance from the center of said circle to the center of said tool for each of said measurement times;

(d) a statistical calculator in communication with said circle calculator and with said eccentricity calculator for receiving said radius signal and said eccentricity signal for each of said measurement times and generating a first statistical signal representative of at least one statistic of said radii and a second statistical signal representative of at least one statistic of said eccentric distances;

(e) an ellipticity calculator in communication with said statistical calculator for receiving said first statistical signal and said second statistical signal and generating an ellipticity signal representative of the ellipticity of said borehole based on said at least one statistic of said radii and said at least one statistic of said eccentric distances; and (f) at least one data disposition device in communication with said ellipticity calculator selected from the group consisting of (i) a data storage device for receiving said ellipticity signal and storing ellipticity data representative of the ellipticity of said borehole, and (ii) a data transmitter for receiving said ellipticity signal and transmitting said ellipticity signal to the surface.

7. The apparatus of claim 6 wherein said acoustic sensors comprise three acoustic transceivers equally spaced around said tool.

8. The apparatus of claim 6 wherein:

(a) said at least one statistic of said radii comprises the mean of said radii and the standard deviation of said radii;

(b) said at least one statistic of said eccentric distances comprises the mean of said eccentric distances and the standard deviation of said eccentric distances; and (c) said ellipticity calculator operates according to the following equation $$E=b_1+b_2\overline{R}+b_3\sigma_R+b_4\overline{R}^2+b_5\sigma_R^2+\ldots$$
$$+c_2\overline{d}_{AB}+c_3\sigma_{d_{AB}}+c_4\overline{d}_{AB}^2+c_5\sigma_{d_{AB}}^2+\ldots$$

wherein E is the ellipticity of said borehole, $\overline{R}$ is the mean of said radii, $\overline{d}_{AB}$ is the mean of said eccentric distances, $\sigma_R$ is the standard deviation of said radii, $\sigma_{d_{AB}}$ is the standard deviation of said eccentric distances, and $b_1, b_2, b_3, \ldots b_k$ and $c_2, c_3, \ldots c_k$ are constants.

9. An apparatus for estimating the ellipticity of an earth borehole using a rotating tool, said tool comprising:

(a) means for measuring at least three respective standoff distances from said tool to at least three respective points on the wall of said borehole at a plurality of measurement times;

(b) means for calculating the radius of a circle defined by said at least three points on the wall of said borehole for each of said measurement times;

(c) means for calculating at least one statistic of said radii;

(d) means for calculating the ellipticity of said borehole based on said at least one statistic of said radii; and (e) means for storing data representative of said ellipticity.

10. The apparatus of claim 9 wherein said means for measuring at least three respective standoff distances comprises three acoustic transceivers equally spaced around said tool.

11. The apparatus of claim 9 further comprising:

(a) means for calculating the eccentric distance from the center of a circle defined by said at least three points on the wall of said borehole to the center of said tool for each of said measurement times; and (b) means for calculating at least one statistic of said eccentric distances;

wherein said means for calculating the ellipticity of said borehole is further based on said at least one statistic of said eccentric distances.

12. The apparatus of claim 11 wherein (a) said at least one statistic of said radii comprises the mean of said radii and the standard deviation of said radii;

(b) said at least one statistic of said eccentric distances comprises the mean of said eccentric distances and the standard deviation of said eccentric distances; and (c) said means for calculating the ellipticity of said borehole operates according to the following equation $$E=b_1+b_2\overline{R}+b_3\sigma_R+b_4\overline{R}^2+b_5\sigma_R^2+\ldots$$
$$+c_2\overline{d}_{AB}+c_3\sigma_{d_{AB}}+c_4\overline{d}_{AB}^2+c_5\sigma_{d_{AB}}^2+\ldots$$

wherein E is the ellipticity of said borehole, $\overline{R}$ is the mean of said radii, $\overline{d}_{AB}$ is the mean of said eccentric distances, $\sigma_R$ is the standard deviation of said radii, $\sigma_{d_{AB}}$ is the standard deviation of said eccentric distances, and $b_1, b_2, b_3, \ldots b_k$ and $c_2, c_3, \ldots c_k$ are constants.

13. A method for estimating the ellipticity of an earth borehole comprising the following steps:

(a) rotating a tool in said borehole, said tool having acoustic sensors spaced peripherally around said tool at multiple sensor locations;

(b) measuring at least three respective standoff distances from said sensor locations to at least three respective points on the wall of said borehole at a plurality of measurement times;

(c) calculating the radius of a circle defined by said at least three points on the wall of said borehole for each of said measurement times;

(d) calculating at least one statistic of said radii; and (e) calculating the ellipticity of said borehole based on said at least one statistic of said radii.

14. A method for estimating the ellipticity of an earth borehole comprising the following steps:

(a) rotating a tool in said borehole, said tool having acoustic sensors spaced peripherally around said tool at multiple sensor locations;

(b) measuring at least three respective standoff distances from said sensor locations to at least three respective points on the wall of said borehole at a plurality of measurement times;

(c) calculating the eccentric distance from the center of a circle defined by said at least three points on the wall of said borehole to the center of said tool for each of said measurement times;

(d) calculating at least one statistic of said eccentric distances; and (e) calculating the ellipticity of said borehole based on said at least one statistic of said eccentric distances.

15. The method of claim 14 wherein:

(a) said at least one statistic of said eccentric distances comprises the mean of said eccentric distances; and (b) said step of calculating the ellipticity of said borehole is according to the equation $$E = 1 + \frac{\overline{d_{AB}}}{2}$$

wherein E is the ellipticity of said borehole and $\overline{d}_{AB}$ is the mean of said eccentric distances.

16. A method for estimating the ellipticity of an earth borehole comprising the following steps:

(a) rotating a tool in said borehole, said tool having acoustic sensors spaced peripherally around said tool at multiple sensor locations;

(b) measuring at least three respective standoff distances from said sensor locations to at least three respective points on the wall of said borehole at a plurality of measurement times;

(c) calculating the radius of a circle defined by said at least three points on the wall of said borehole for each of said measurement times;

(d) calculating the eccentric distance from the center of said circle to the center of said tool for each of said measurement times;

(e) calculating at least one statistic of said radii;

(f) calculating at least one statistic of said eccentric distances; and (g) calculating the ellipticity of said borehole based on said at least one statistic of said radii and said at least one statistic of said eccentric distances.

17. The method of claim 16 wherein:

(a) said at least one statistic of said radii comprises the mean of said radii and the standard deviation of said radii;

(b) said at least one statistic of said eccentric distances comprises the mean of said eccentric distances and the standard deviation of said eccentric distances; and (c) said step of calculating the ellipticity of said borehole is according to the following equation $$E=b_1+b_2\overline{R}+b_3\sigma_R+b_4\overline{R}^2+b_5\sigma_R^2+\ldots$$
$$+c_2\overline{d}_{AB}+c_3\sigma_{d_{AB}}+c_4\overline{d}_{AB}^2+c_5\sigma_{d_{AB}}^2+\ldots$$

wherein E is the ellipticity of said borehole, $\overline{R}$ is the mean of said radii, $\overline{d}_{AB}$ is the mean of said eccentric distances, $\sigma_R$ is the standard deviation of said radii, $\sigma_{d_{AB}}$ is the standard deviation of said eccentric distances, and $b_1, b_2, b_3, \ldots b_k$ and $C_2, C_3, \ldots c_k$ are constants.

* * * * *